US008550268B1

(12) United States Patent
Chisholm

(10) Patent No.: US 8,550,268 B1
(45) Date of Patent: Oct. 8, 2013

(54) PACKAGE WITH GLASS CONTAINER AND GLASS CLOSURE

(75) Inventor: Brian J. Chisholm, Sylvania, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 0 days.

(21) Appl. No.: 13/545,374

(22) Filed: Jul. 10, 2012

(51) Int. Cl.
*B65B 7/28* (2006.01)

(52) U.S. Cl.
USPC ..... 215/44; 215/274; 215/276; 220/319

(58) Field of Classification Search
USPC ..... 215/44, 274, 276, 344; 220/319
See application file for complete search history.

(56) References Cited

U.S. PATENT DOCUMENTS

| | | | | |
|---|---|---|---|---|
| 293,035 | A | | 2/1884 | Jones |
| 660,739 | A | | 10/1900 | Taylor |
| 1,298,313 | A | | 3/1919 | Ebelling |
| 1,394,545 | A | | 10/1921 | French |
| 1,748,852 | A | | 2/1930 | Smith |
| 1,866,224 | A | | 7/1932 | Punte |
| 1,975,703 | A | | 10/1934 | Vitale |
| 2,047,951 | A | | 7/1936 | Eberhart |
| 2,075,477 | A | | 3/1937 | Smith |
| 2,085,277 | A | | 6/1937 | Smith |
| 2,372,156 | A | | 3/1945 | Buchman |
| 2,549,917 | A | | 4/1951 | Milbrandt |
| 3,603,472 | A | * | 9/1971 | Lecinski et al. ..... 215/253 |
| 3,924,772 | A | * | 12/1975 | Magnani ..... 215/276 |
| 4,844,270 | A | | 7/1989 | Coffman |
| 5,215,717 | A | | 6/1993 | Conant et al. |
| 2006/0278642 | A1 | | 12/2006 | Pugne et al. |

* cited by examiner

*Primary Examiner* — J. Gregory Pickett
*Assistant Examiner* — Raven Collins

(57) ABSTRACT

A closure and container package includes a glass container having an open mouth surrounded by an annular neck. An annular finish has at least one external attachment feature and is non-rotatably secured to the neck of the container. An annular skirt has at least one internal attachment feature for removable securement to the finish, and a glass closure has a circular periphery coupled to the skirt such that the skirt removably mounts the glass closure to the glass container. The finish can be of plastic or rubber, and the skirt preferably has a radially inwardly directed flange. The circular periphery of the glass closure preferably has a peripheral edge captured between the flange and a retention feature of the skirt. The peripheral edge of the glass closure preferably is annular and planar.

20 Claims, 1 Drawing Sheet

PACKAGE WITH GLASS CONTAINER AND GLASS CLOSURE

The present disclosure relates to a closure and container package that is constructed primarily of glass.

BACKGROUND AND SUMMARY OF THE DISCLOSURE

A general object of the present disclosure is to provide a closure and container package that is constructed primarily of glass, and which is readily suited for elevated temperature applications such as hot-fill and retort applications.

The present disclosure embodies a number of aspects that can be implemented separately from or in combination with each other.

A closure and container package in accordance with one aspect of the present disclosure includes a glass container having an open mouth surrounded by an annular neck. An annular finish has at least one external attachment feature and is non-rotatably secured to the neck of the container. An annular plastic skirt has at least one internal attachment feature for removable securement to the finish, and a glass closure has a circular periphery coupled to the skirt such that the skirt removably mounts the glass closure to the glass container. The finish can be of plastic or rubber, and the skirt preferably has a radially inwardly directed flange. The circular periphery of the glass closure preferably has a peripheral edge captured between the flange and a retention feature of the skirt. The peripheral edge of the glass closure preferably is annular and planar.

A closure and container package in accordance with another aspect of the disclosure includes a glass container having an open mouth surrounded by an annular neck and an annular finish having at least one external thread segment. An annular plastic skirt has at least one internal thread segment for removable threaded securement to the finish, and a glass closure has a circular periphery coupled to the plastic skirt such that the plastic skirt removably threadably mounts the glass closure to the finish and the glass container. The plastic skirt preferably has a radially inwardly directed flange, and the circular periphery of the glass closure preferably has a peripheral edge captured between such flange and a retention feature of the skirt. The flange preferably is annular and continuous, and the peripheral edge of the closure preferably is annular and planar. The finish of the glass container preferably is a separate plastic finish non-rotatably secured to the neck of the container, and preferably has a radially inwardly directed seal flange for capture between an axially facing surface of the glass container and the circular periphery of the glass closure.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
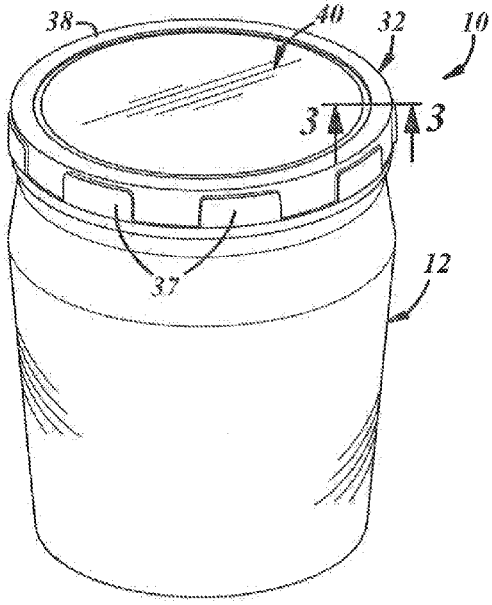
FIG. 1 is a perspective view of a closure and container package in accordance with an exemplary embodiment of the present disclosure.
Figure 2:
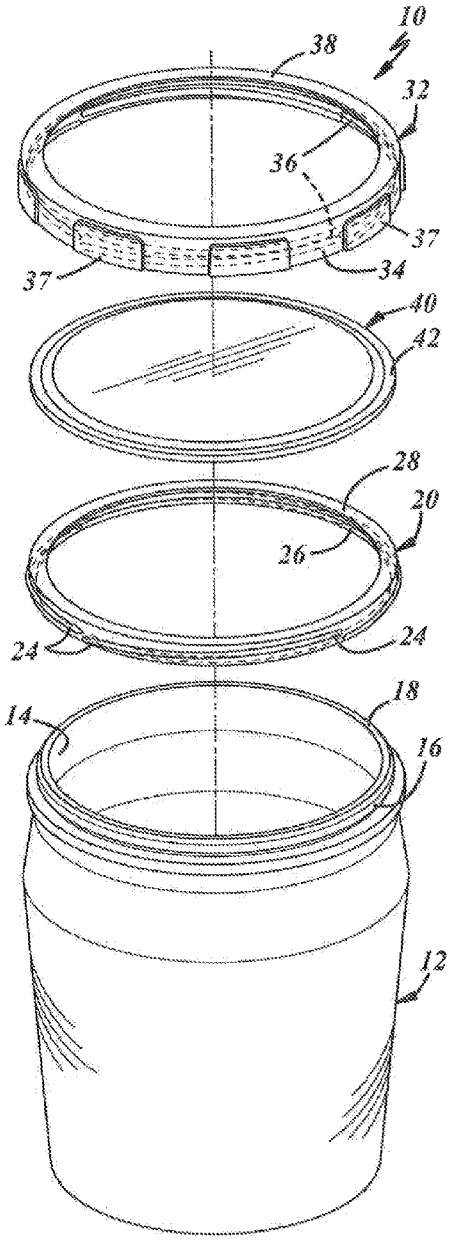
FIG. 2 is an exploded perspective view of the package in FIG. 1.

The drawings illustrate a package 10 that includes a glass container 12 having a neck 14 with an external bead 16. Bead 16 preferably is circumferentially continuous around neck 14, which preferably is annular and continuous. Neck 14 has an axially facing sealing end surface 18. Container 12 is illustrated in FIGS. 1 and 2 as ajar, but could be any type of glass container.

An annular finish 20 is non-rotatably secured to neck 14. Finish 20 preferably is of plastic or rubber construction, having a substantially cylindrical wall 22 with at least one external attachment feature 24 and an internal bead 26 received by snap fit over bead 16 on neck 14. Attachment feature 24 preferably is a continuous or segmented thread, but could be a snap-on or bayonet feature, for example. Bead 26 can be continuous or segmented. FIG. 2. illustrates a four-segment external thread 24, although any number of thread segments can be employed. Finish 20 also has a radially inwardly directed circumferentially continuous annular seal flange 28. A circumferentially continuous seal bead 30 is disposed at a radially inward periphery of flange 28 for sealing engagement with sealing surface 18 of neck 14, as will be described below.

Figure 3:
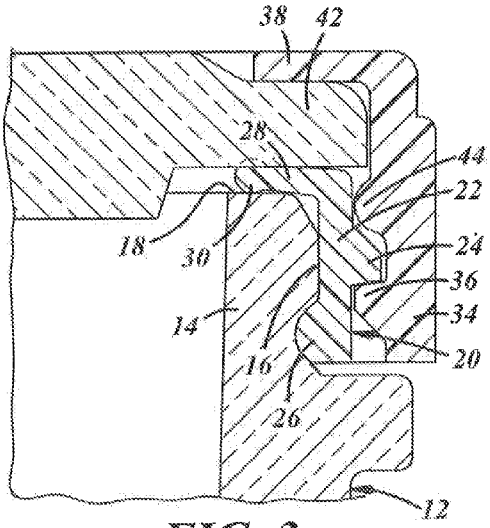
FIG. 3 is a fragmentary sectional view taken substantially along the line 3-3 in FIG. 1.

An annular plastic skirt 32 has a cylindrical wall 34 with at least one internal attachment feature 36 for engagement with external attachment feature(s) 24 on finish 20. Features 24, 36 preferably comprise spiral thread segments. Skirt 32 also has a radially inwardly directed flange or lip 38. A glass closure 40 has a periphery 42, preferably planar and circular, that is captured between flange 38 and a radially inwardly directed retention feature(s) 44 carried by the skirt 32. The retention feature(e) may include, for example, an annular bead that may be circumferentially continuous or segmented. The central portion of closure 40 can be of any suitable geometry, with a generally flat planar geometry being illustrated in the drawings. Skirt 32 has spaced external lugs 37 on wall 34 to facilitate gripping and unthreading of skirt 32 and closure 40. The seal bead 30 is disposed for sealing engagement with the sealing surface 18 of the neck 14 and with an undersurface of the closure 40. As shown in FIG. 3, a transverse cross section of the seal bead 30 may be semi-circular. Accordingly, the seal bead 30 may be bulbous, and is shown in FIG. 3 in solid and hidden lines according to an uncompressed state of the seal bead 30.

Finish 20 is made non-rotatable with respect to neck 14 of container 12 by any suitable means, such as by adhesive or interference features such as lugs and detents on any surface of the neck or finish. A segmented bead 26 could cooperate with a detent or lug on the finish to prevent rotation of finish 20, for example. See, for example, US 2006/0278642, the disclosure of which is incorporated herein by reference in its entirety. Thus, the subassembly of skirt 32 and closure 40 can be readily threaded onto and unthreaded from the subassembly of finish 20 and container 12. Container 12 and closure 40 preferably are of glass construction. Finish 20 and skirt 32 preferably are of rubber or plastic construction. Any suitable rubber or plastic can be employed, such as polypropylene, polycarbonate, polyethylene, thermoset material or composite material.

There thus has been disclosed a closure and container package that fully satisfies all of the objects and aims previously set forth. The package is eminently suitable for hot-fill applications of product at 185 F and above, and can be developed for retort applications at temperatures of 260° F. and above. The disclosure has been presented in conjunction with an exemplary embodiment, and modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A closure and container package that includes:

a glass container having an open mouth surrounded by an annular neck, an annular finish having at least one external attachment feature, said finish being secured to said neck and non-rotatable with respect to said neck, an annular plastic skirt having at least one internal attachment feature for removable attachment to said finish, and a glass closure having a circular periphery coupled to said plastic skirt such that said plastic skirt removably mounts said glass closure to said glass container, wherein said plastic skirt has a radially inwardly directed flange, and said circular periphery of said glass closure has a peripheral edge captured between said flange and a retention feature on said skirt.

2. The package set forth in claim 1 wherein said flange is annular and continuous around said skirt.

3. The package set forth in claim 1 wherein said peripheral edge is annular and planar.

4. The package set forth in claim 3 wherein said annular plastic skirt has external lugs to assist gripping and unthreading of said skirt and said closure.

5. The package set forth in claim 1 wherein said finish has an internal bead received by snap fit over an external bead on said neck.

6. The package set forth in claim 5 wherein said finish and/or said annular neck includes means for preventing rotation of said finish with respect to said neck.

7. A closure and container package that includes:

a glass container having an open mouth surrounded by an annular neck, an annular finish having at least one external attachment feature, said finish being secured to said neck and non-rotatable with respect to said neck, an annular plastic skirt having at least one internal attachment feature for removable attachment to said finish, and a glass closure having a circular periphery coupled to said plastic skirt such that said plastic skirt removably mounts said glass closure to said glass container, wherein said finish has a radially inwardly directed seal flange for capture between an axially facing surface of said neck and said circular periphery of said closure.

8. The package set forth in claim 7 wherein said seal flange has a circumferentially continuous bead for sealing engagement with the axially facing surface of said neck and with an undersurface of said closure.

9. The package set forth in claim 1 wherein said annular finish is of plastic or rubber construction.

10. A closure and container package that includes:

a glass container having an open mouth surrounded by an annular neck, an annular finish on the container neck and having at least one external thread segment, an annular plastic skirt having at least one internal thread segment for removable threaded securement to said finish, and a glass closure having a circular periphery coupled to said plastic skirt such that said plastic skirt removably threadably mounts said glass closure to said finish and said glass container, wherein said skirt has a radially inwardly directed flange, and said circular periphery of said glass closure has a peripheral edge captured between said flange and a retention feature on said skirt.

11. The package set forth in claim 10 wherein said flange is annular and continuous around said skirt.

12. The package set forth in claim 11 wherein said peripheral edge is annular and planar.

13. The package set forth in claim 10 wherein said annular plastic skirt has external lugs to assist gripping and unthreading of said skirt and said closure.

14. The package set forth in claim 10 wherein said annular finish is of plastic or rubber construction and is non-rotatably secured to said neck.

15. The package set forth in claim 14 wherein said finish has an internal bead received by snap fit over an external bead on said neck.

16. The package set forth in claim 15 wherein said finish and/or said annular neck includes means for preventing rotation of said finish with respect to said neck.

17. A closure and container package that includes:

a glass container having an open mouth surrounded by an annular neck, and an annular finish having at least one external thread segment, an annular plastic skirt having at least one internal thread segment for removable threaded securement to said finish, and a glass closure having a circular periphery coupled to said plastic skirt such that said plastic skirt removably threadably mounts said glass closure to said finish and said glass container, wherein said finish has a radially inwardly directed seal flange for capture between an axially facing surface of said neck and said circular periphery of said closure.

18. The package set forth in claim 17 wherein said seal flange has a circumferentially continuous bead for sealing engagement with the axially facing surface of said neck and with an undersurface of said closure.

19. The package set forth in claim 1 wherein said annular plastic skirt includes a cylindrical wall extending from the flange and from which the retention feature extends radially inwardly.

20. The package set forth in claim 10 wherein said annular plastic skirt includes a cylindrical wall extending from the flange and from which the retention feature extends radially inwardly.

* * * * *